US006138854A

United States Patent [19]

Kaneko et al.

[11] Patent Number: 6,138,854

[45] Date of Patent: Oct. 31, 2000

[54] LID HAVING AN OPENING SEALED BY A PEELABLE PULL-CAP WITH A RECESS FOR RECEIVING THE PULL-CAP AFTER REMOVAL

[75] Inventors: Masamichi Kaneko, Tokyo; Hidetoshi Konno, Yokohama, both of Japan; Elmar Mock, Biel, Switzerland

[73] Assignee: Tetra Laval Holdings & Finance S.A., Switzerland

[21] Appl. No.: 09/194,063

[22] PCT Filed: Jun. 20, 1997

[86] PCT No.: PCT/JP97/02116

§ 371 Date: Feb. 4, 1999

§ 102(e) Date: Feb. 4, 1999

[87] PCT Pub. No.: WO97/48610

PCT Pub. Date: Dec. 24, 1997

[30] Foreign Application Priority Data

Jun. 20, 1996 [JP] Japan ..... 8-159409

[51] Int. Cl.[7] ..... B65D 51/18

[52] U.S. Cl. ..... 220/254; 220/270; 220/379; 220/791

[58] Field of Search ..... 220/254, 256, 220/258, 268–270, 379, 744, 359.2, 783, 784, 789–791

[56] References Cited

U.S. PATENT DOCUMENTS

| | | | |
|---|---|---|---|
| 438,898 | 10/1890 | Rodiger | 220/379 |
| 3,289,881 | 12/1966 | Ganung | 220/254 |
| 3,924,776 | 12/1975 | Horst | 220/269 |
| 4,000,839 | 1/1977 | Tecco et al. | 220/254 X |
| 4,244,491 | 1/1981 | Takahashi et al. | 220/270 |
| 4,819,829 | 4/1989 | Rosten et al. | 220/254 X |
| 4,840,289 | 6/1989 | Fait et al. | 220/270 |
| 4,989,746 | 2/1991 | Pierce | 220/254 |
| 5,165,563 | 11/1992 | McKendry | 220/254 |
| 5,573,130 | 11/1996 | Chanal et al. | 220/212.5 X |
| 5,799,813 | 9/1998 | Letica | 220/254 |

*Primary Examiner*—Nathan J. Newhouse
*Attorney, Agent, or Firm*—Lorusso & Loud

[57] ABSTRACT

The object is to provide a lid (11) that does not cause environmental pollution. The lid (11) comprises a lid body (12) formed of a plastic sheet and a pull-cap (14) formed of a plastic sheet. The lid body (12) covers a top end opening of a cylindrical container body (15) and has an opening-for-drinking (16). The pull-cap (14) has a sealing portion (20) for covering the opening-for-drinking (16) of the lid body (12) and for sealing the periphery of the opening-for-drinking (16), and a pull-tab portion (21) formed integrally with the sealing portion (20). The sealing portion (20) has an easy-to-peel layer. A holding groove portion is formed in the lid body (12) at a location different from the location of the opening-for-drinking (16), and a pull-cap holding section for holding the pull-cap (14) peeled off is formed at the holding groove portion. Since the pull-cap (14) can be held by the pull-cap holing section after it is peeled off, the pull-cap (14) is not likely to be thrown away carelessly after the pull-cap (14) is peeled off the lid body (12) to open the beverage container.

6 Claims, 5 Drawing Sheets

LID HAVING AN OPENING SEALED BY A PEELABLE PULL-CAP WITH A RECESS FOR RECEIVING THE PULL-CAP AFTER REMOVAL

TECHNICAL FIELD

The present invention relates to a lid.

BACKGROUND ART

Conventionally, when a beverage container is used, the inside of a cylindrical container body is sterilized, and then the container body is filled with the beverage and sealed with a lid.

A typical lid of the so-called peelable-seal type (membrane type) comprises a sheet of aluminum foil laminated with a stretched film of PET (polyethylene telephthalate) having an easy-to-peel layer for facilitating peeling operation which is formed on the surface of the lid to be in contact with the container body. The lid covers and seals the top opening of the container body.

Another type of lid has an opening-for-drinking formed in the lid body, and the opening-for-drinking is covered with a pull-tab comprising PET and aluminum foil and having an easy-to-peel layer, wherein the pull-tab and the periphery of the opening-for-drinking are sealed together.

However, when the conventional peelable-seal type lid is used, the sealing force between the lid and the container body must be set to be strong enough to prevent the lid from detaching from the container body during transportation, while the sealing force must be set to be weak enough to afford easy peeling of the lid from the container body to open the container. Therefore, setting a proper sealing force to achieve a balance between those two requirements is not easy.

In addition, when the lid is removed from the container body to open the container, the opening-for-drinking may become too large and the contained beverage may spill easily.

On the other hand, when the lid with a pull-tab for sealing is used, because an easy-to-peel layer is formed on the pull-tab, the appearance of the lid no longer gives an impression of high quality.

Accordingly, there may be employed another type of a lid wherein an opening-for-drinking is formed on the lid body and is covered and sealed with a pull-cap. In that case, the sealing force between the lid and the container body may be made strong enough, and the sealing force of the pull-cap may be made weak enough, so that the lid may not detach from the container body during transportation, and easy opening of the beverage container may be afforded.

Moreover, the opening-for-drinking does not become too large, and the appearance of the lid gives an impression of high quality.

However, after the pull-cap is removed to open the beverage container, the pull-cap is sometimes thrown away without consideration, thereby causing environmental pollution.

The object of the present invention is to solve the above-mentioned problems of the conventional lids and to provide a lid that will not detach from the container body during transportation, that affords easy opening of the container, whose opening-for-drinking does not become too large, whose appearance gives an impression of high quality, and that does not cause environmental pollution.

DISCLOSURE OF THE INVENTION

To achieve the above object, the lid of the present invention comprises a lid body and a pull-cap. The lid body is formed of a plastic sheet and is adapted to cover a top end opening of a cylindrical container body, and has an opening-for-drinking formed therein. The pull-cap is formed of a plastic sheet and includes a sealing portion for covering the opening-for-drinking of the lid body and for sealing the periphery of the opening-for-drinking and a pull-tab portion formed integrally with the sealing portion. The sealing portion has an easy-to-peel layer.

A holding groove portion is formed at a location different from the location of the opening-for-drinking in the lid body, and pull-cap holding means for holding the pull-cap peeled off is formed at the holding groove portion.

In this case, strong sealing force between the lid and the container body can prevent detachment of the lid from the container during transportation. Simultaneously, through proper design of the easy-to-peel layer, the sealing force between the pull-cap and the lid body can be made weak enough to afford easy opening of the container. The length of the sealing portion can be made small, since the easy-to-peel layer is formed only at the sealing portion and the opening-for-drinking is small. Therefore, the pull-cap does not detach from the lid body during transportation.

Since the opening-for-drinking is sufficiently small when the container is opened, the contained beverage does not spill easily. Moreover, appearance of the lid gives an impression of high quality.

Since the pull-cap can be held by the pull-cap holing means after it is peeled off the lid body, the pull-cap is not likely to be thrown away carelessly after the container is opened.

Therefore, the pull-cap does not cause environmental pollution.

Moreover, a user can drink a portion of the beverage and then close the container because the pull-cap will not be missed during drinking.

BEST MODE FOR CARRYING OUT THE INVENTION

An embodiment of the present invention will next be described in detail with reference to the drawings.

Figure 1:
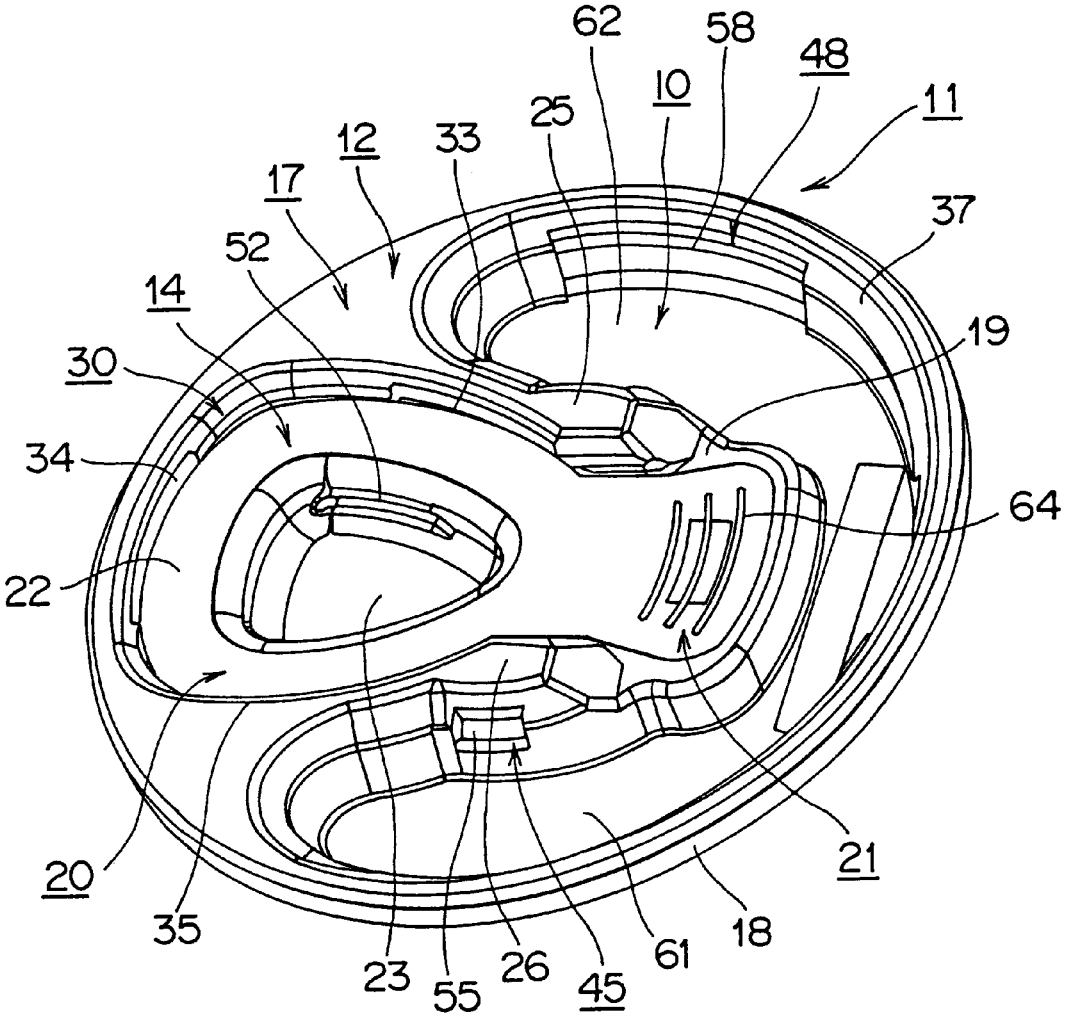
FIG. 1 is a perspective view of a lid according to an embodiment of the present invention.
Figure 2:
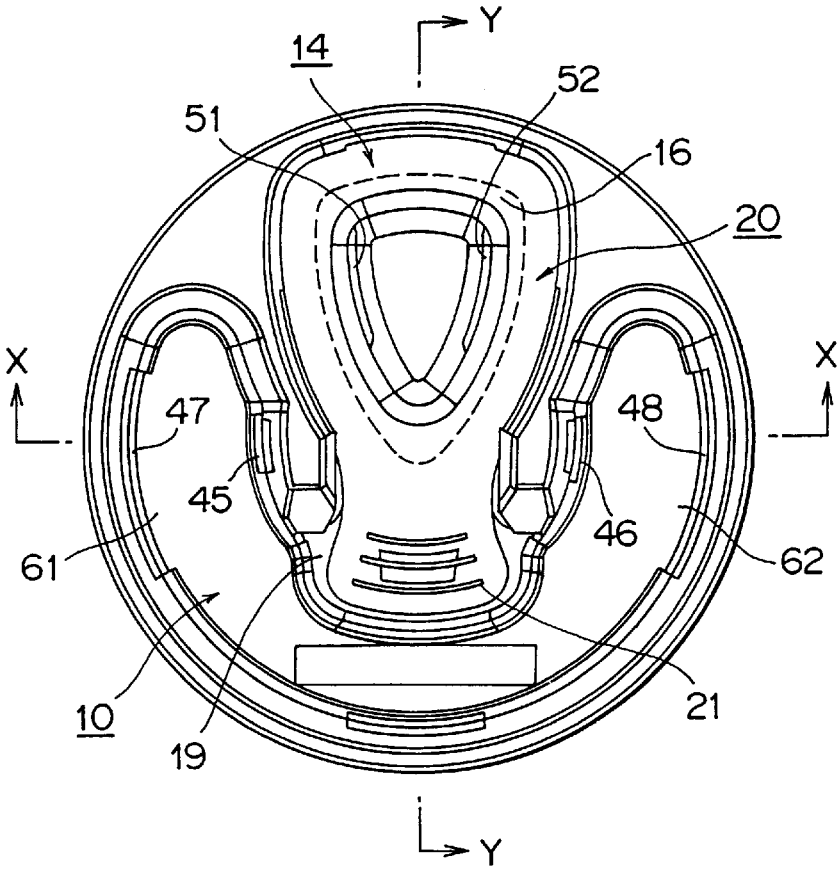
FIG. 2 is a plane view of the lid according to the embodiment of the present invention.
Figure 3:
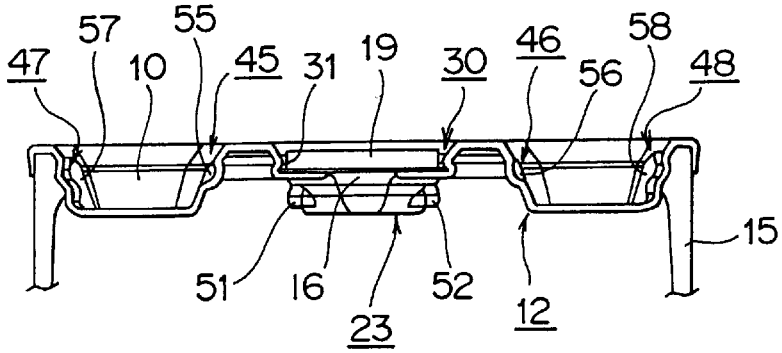
FIG. 3 is a cross-sectional view taken along line X—X of FIG. 2.
Figure 4:
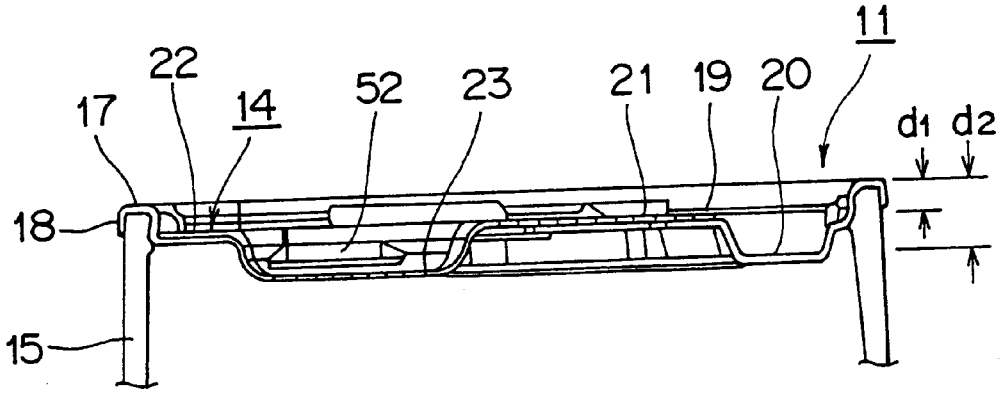
FIG. 4 is a cross-sectional view taken along line Y—Y of FIG. 2.
Figure 5:
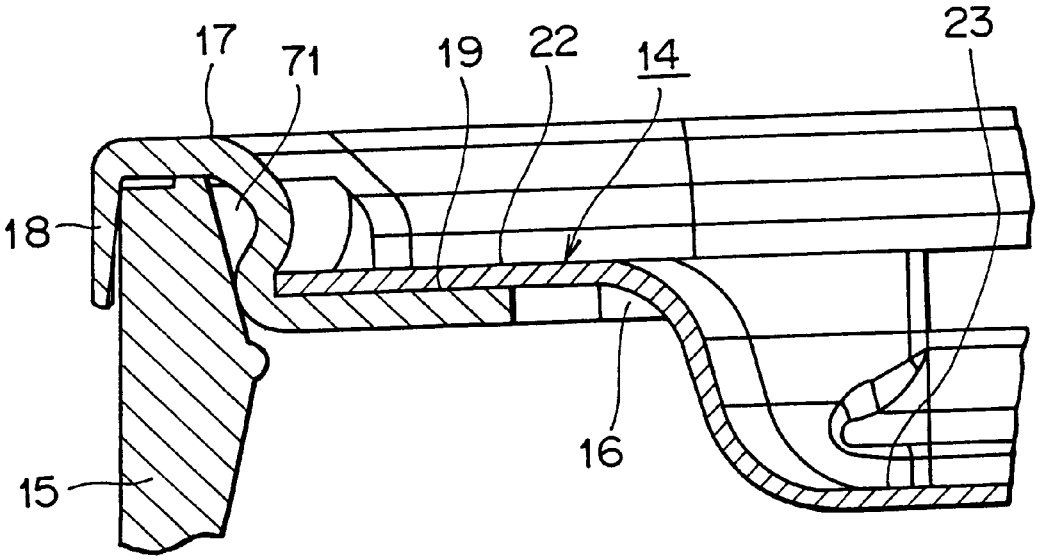
FIG. 5 is a first enlarged view of a main portion of the lid according to the embodiment of the present invention.
Figure 6:
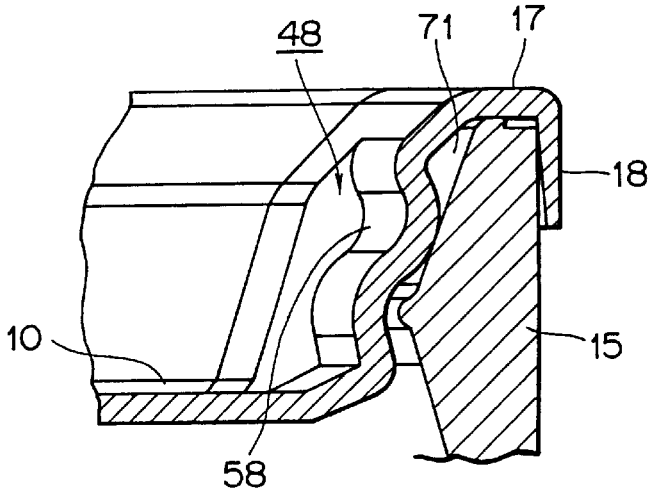
FIG. 6 is a second enlarged view of a main portion of the lid according to the embodiment of the present invention.
Figure 7:
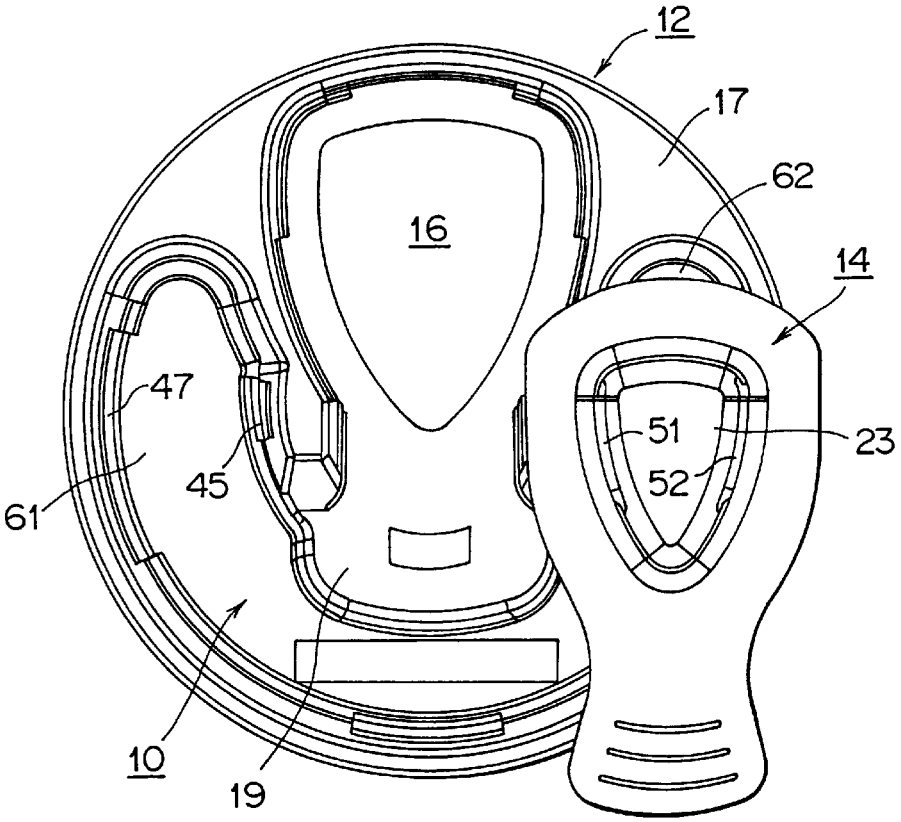
FIG. 7 is a plane view showing the pull-cap being held accoding to the embodiment of the present invention.
Figure 8:
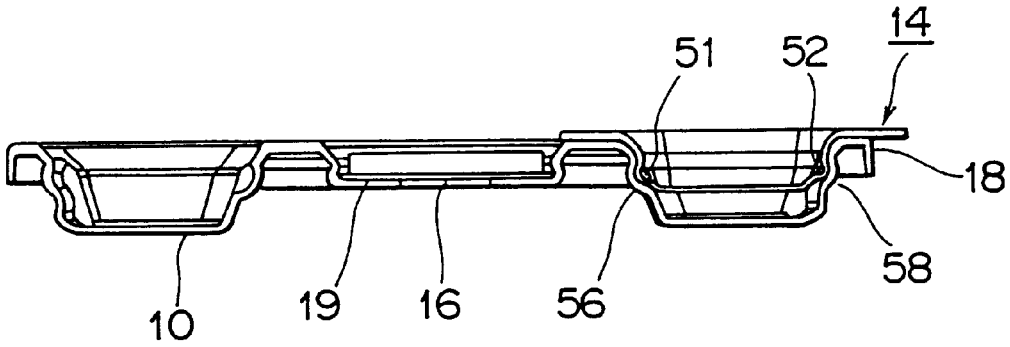
FIG. 8 is a cross-sectional view showing the pull-cap being held according to the embodiment of the present invention.
Figure 9:
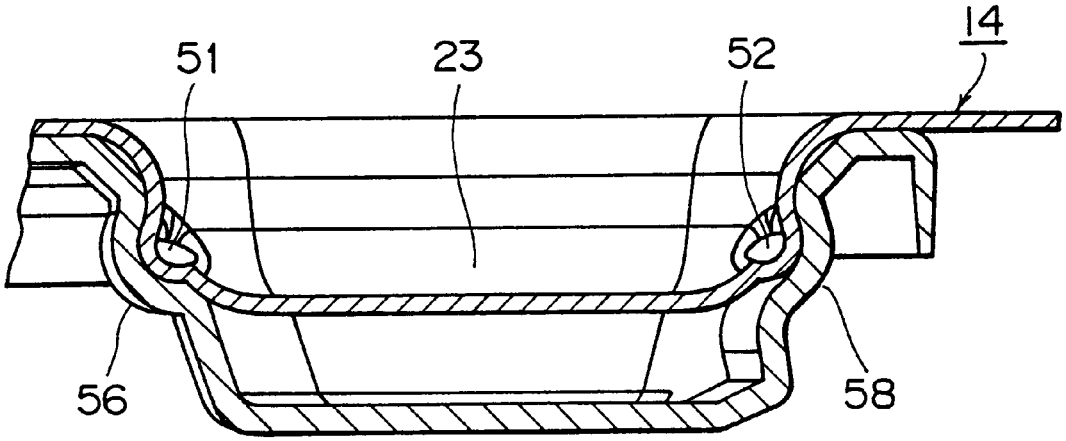
FIG. 9 is an enlarged cross-sectional view of a main portion showing the pull-cap being held according to the embodiment of the present invention.

FIG. 1 is a perspective view of a lid according to an embodiment of the present invention; FIG. 2 is a plane view of the lid according to the embodiment of the present invention; FIG. 3 is a cross-sectional view taken along line X—X of FIG. 2; FIG. 4 is a cross-sectional view taken along line Y—Y of FIG. 2; FIG. 5 is a first enlarged view of a main portion of the lid according to the embodiment of the present invention; FIG. 6 is a second enlarged view of a main portion of the lid according to the embodiment of the present invention; FIG. 7 is a plane view showing the pull-cap being held accoding to the embodiment of the present invention; FIG. 8 is a cross-sectional view showing the pull-cap being held according to the embodiment of the present invention; and FIG. 9 is an enlarged cross-sectional view of a main portion showing the pull-cap being held according to the embodiment of the present invention.

In the drawings, a lid 11 is composed of a lid body 12 and a pull-cap 14. The lid body 12 is formed of a plastic sheet and covers a top end opening of a cylindrical container body 15. The pull-cap 14 is formed of a plastic sheet and attached to the lid body 12.

The lid body 12 is formed of a plastic sheet having a gas-barrier property (especially against oxygen). The lid body 12 is formed from a multi-layer sheet of, for example, PP (polypropylene)/EVOH (ethylene vinyl alcohol copolymer)/PP through use of a sheet-forming technique such as vacuum forming method. EVOH has a barrier property against oxygen.

The pull-cap 14 is formed of a plastic sheet having a gas-barrier property (especially against oxygen). The pull-cap 14 is formed from a multi-layer sheet of, for example, PP/EVOH/PP coated with an easy-to-peel layer on one side and a layer of heat resistant resin such as polycarbonate on the other side through use of the above sheet-forming technique, wherein the easy-to-peel layer is formed on the side facing the lid body 12.

The lid body 12 comprises a circular top portion 17, a skirt portion 18, a first groove portion 19, and a second groove portion 10. The skirt portion 18 extends downward from the peripheral edge of the top portion 17 and surrounds the container body 15. The first groove portion 19 is formed to project downward from the top portion 17 at a predetermined depth $d_1$. The second groove portion 10 is formed to project downward further than the first groove portion 19 from the top portion 17 at a predetermined depth $d_2$, and serves as a holding groove portion. A substantially triangular opening-for-drinking 16 is formed in the first groove portion 19.

A beverage container is formed by sealing the container body 15 with the lid 11. The sealing force between the lid 11 and the container body 15 is made sufficiently strong such that the lid 11 does not detach from the container body 15 during transportation of the beverage container. Moreover, through proper design of the easy-to-peel layer, the sealing force between the pull-cap 14 and the lid body 12 can be made sufficiently weak so as to afford easy opening of the beverage container. Since the easy-to-peel layer is formed only at a sealing portion 20 of the pull-cap 14 and the opening-for-drinking 16 is small, the length of the sealing portion 20 can be made small. Therefore, the pull-cap 14 does not detach from the lid body 12 during transportation.

Since the opening-for-drinking 16 is sufficiently small when the beverage container is opened, the contained beverage does not spill easily. Moreover, the appearance of the lid 11 gives an impression of high quality.

The shape of the first groove portion 19 corresponds to the shape of the pull-cap 14, and the first groove portion 19 extends radially through the center of the lid body 12. The second groove portion 10 extends in the shape of a letter "C" surrounding the first groove portion 19 and the opening-for-drinking 16, thereby forming a first pull-cap holding space 61 and a second pull-cap holding space 62.

The pull-cap 14 comprises a sealing portion 20 for covering and sealing the opening-for-drinking 16, and a pull-tab portion 21 integrally formed with the sealing portion 20. The sealing portion 20 comprises a flange portion 22 extending along the periphery of the opening-for-drinking 16, and a groove portion 23 which is formed inside the flange portion 22, extends downward through the opening-for-drinking 16 and has substantially the same shape as the opening-for-drinking 16.

At the periphery of the sealing portion 20, a pair of wall portions 25 and 26 for separating the first and the second groove portions 19 and 10 are formed by the top portion 17, while no walls are formed around the pull-tab portion 21 so that the first and the second groove portions 19 and 10 are connected with each other. Therefore, the pull-tab portion 21 can be easily picked up to peel the pull-cap 14 off the lid body 12. A plurality of ribs 64 are formed in the pull-tab portion 21 so as to facilitate picking up the pull-tab portion 21 for peeling the pull-cap 14 off the lid body 12. Projections (not shown) are formed on the lid body 12 so that the pull-tab portion 21 is raised from the lid body 12 and the pull-tab portion 21 can be easily picked up.

In the wall surface 30 of the first groove portion 19 around the opening-for-drinking 16, a groove 31 is formed along the periphery of the flange portion 22. The periphery of the flange portion 22 is fitted into the groove 31.

When the lid 11 is assembled, first, the sealing portion 20 of the pull-cap 14 is disposed on the opening-for-drinking 16 of the lid body 12, and is then pushed downward so that the substantially entire periphery of the flange portion 22 of the sealing portion 20 is fitted into the groove 31.

Subsequently, the flange portion 22 of the sealing portion 20 is welded to the periphery of the opening-for-drinking 16, through use of fusing means, so that the opening-for-drinking 16 is covered by the pull-cap 14, and the lid body 12 and the pull-cap 14 are sealed together.

Before the container body 15 is filled with the beverage, the lower surface of the lid 11 is sterilized. When the pull-cap 14 is attached to the lid 11, the peripheral edge of the flange portion 22 is fitted into the groove 31. Therefore, a sealed closed space is not formed between the pull-cap 14 and the lid 11 at the lower side of the lid 11, and sterilizing material will not remain in the sealed closed space after the lid 1.1 is assembled.

Thus, after the assembled lid 11 is disposed on the top of the container body 15 filled with beverage, heat or ultrasonic vibration is applied. As a result, the lid 11 and the container body 15 are sealed together. At this time, the lid 11 and the container body 15 are temporarily coupled together by fitting the top end of the container body 15 into a groove 71 formed inside the skirt portion 18. For this temporary coupling, the groove 71 is made narrower at the lower end of the skirt portion 18 than at the upper end thereof so that the top of the container body 15 is held by the skirt portion 18 when the top of the container body 15 is inserted into the groove 71. The groove 71 and the top of the container body 15 constitute temporary coupling means.

Therefore, when the lid 11 after having its lower surface sterilized and the container body 15 after having its inside surface sterilized are temporarily coupled, dust is prevented from entering the container body 15. As a result, a step of sterilizing the lower surface of the lid 11 and the inside of the container body 15 is not required before the step of filling the beverage in a filling plant.

When the beverage container is opened, the pull-tab 21 of the pull-cap 14 is picked and pulled up by fingers, and the easy-to-peel layer formed on the lower surface of the sealing portion 20 is peeled off the periphery of the opening-for-drinking 16. Thus, the pull-cap 14 can be easily detached from the lid body 12.

Since the groove portion 23 is formed in the pull-cap 14 in the present embodiment, the beverage is prevented from easily spilling from the opening-for-drinking 16 upon the occurrence of vibration of the surface of the beverage in the container when the pull-cap 14 is peeled off the lid body 12.

After the pull-cap 14 is peeled off the lid body 12, the opening-for-drinking 16 can be closed again by fitting the peripheral edge of the flange portion 22 into the groove 31 and pushing the pull-cap 14 toward the lid 11. Subsequently, the opening-for-drinking 16 can be opened and closed repeatedly through detachment of the pull-cap 14 from the lid 11 and attachment of the pull-cap 14 to the lid 11. Thus, the user can drink a portion of the beverage and then close the container.

Moreover, two arcuate projections 51 and 52 are formed in the groove portion 23 at two locations along the circumference thereof so as to prevent the groove portion 23 which penetrates the opening-for-drinking 16 from easily coming out of the opening-for-drinking 16.

Three recesses 33, 34, and 35 are formed in the wall surface 30 at three locations along the circumference thereof so that the pull-cap 14 can be easily attached to and detached from the lid 11.

Four recesses 45, 46, 47, and 48 are formed in a wall surface 37 of the second groove portion 10 at four locations along the circumference thereof for temporarily holding the pull-cap 14 on the lid 11 after the pull-cap 14 is peeled off. The recess 45 faces the recess 47, and the recess 46 faces the recess 48. Arcuate depressions 55, 56, 57, and 58 are formed at the recess 45 through 48 at substantially the same depth as that of the first groove portion 19. The depressions 55 and 57 form first pull-cap holding means, and the depressions 56 and 58 form second pull-cap holding means.

When the pull-cap 14 after being peeled off the lid body 12 is placed on the first pull-cap holding space 61 and is pushed down, the projections 51 and 52 are fitted into the depressions 57 and 55, respectively. Thus, the pull-cap 14 is held in the first pull-cap holding space 61.

When the pull-cap 14 after being peeled off the lid body 12 is placed on the second pull-cap holding space 62 and is pushed down, the projections 51 and 52 are fitted into the depressions 56 and 58, respectively. Thus, the pull-cap 14 is held in the second pull-cap holding space 62 as shown in FIGS. 7 through 9.

Since the first and the second pull-cap holding means are formed to the respective sides of the opening-for-drinking 16, both right-handed and left-handed persons can hold the pull-cap 14 at the first pull-cap holding space 61 or the second pull-cap holding space 62. Since the pull-tab portion 21 is small, the pull-cap 14 does not interfere with drinking while the pull-cap 14 is held at the first pull-cap holding space 61 or the second pull-cap holding space 62.

Moreover, since the pull-cap 14 is not likely to be thrown away carelessly after being peeled off the lid body 12 to open the container, the pull-cap 14 does not cause environmental pollution.

Furthermore, since the pull-cap 14 is not lost during drinking, the user can drink a portion of the beverage and then close the container.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention can be applied to lids for beverage containers.

What is claimed is:

1. A lid comprising:

(a) a lid body formed of a plastic sheet for covering an open top end of a cylindrical container body and having an opening for drinking;

(b) a pull-cap formed of a plastic sheet, said pull-cap having a sealing portion for covering said opening and for sealing with a portion of said lid body surrounding said opening, and a pull-tab portion formed integrally with said sealing portion, said sealing portion having a surface providing said sealing formed of a peelable material for facilitating separation from said lid body portion; and (c) a holding recess formed in said lid body spaced from partially surrounding and curving around said opening, and pull-cap holding means for holding said pull-cap within said holding recess after separation from said lid body portion.

2. A lid according to claim 1, wherein said holding recess is C-shaped and extends to opposing sides of said opening.

3. A lid according to claim 1, wherein one of said pull-cap holding means is formed in said holding recess on each of opposing sides of said opening.

4. A lid according to claim 1, wherein said pull-cap holding means includes depressions formed in said holding recess and projections on said pull-cap for seating within said depressions.

5. A lid according to claim 1, wherein said lid body has a skirt portion extending from a peripheral edge of said lid body, said skirt portion having a circumferential groove for receiving the top end of the container body.

6. A lid according to claim 1, wherein a cap-receiving groove is formed in a wall surface that surrounds said opening, and a peripheral edge of said pull-cap is fitted into said cap-receiving groove.

* * * * *